US008978428B2

(12) United States Patent
Trent et al.

(10) Patent No.: US 8,978,428 B2
(45) Date of Patent: Mar. 17, 2015

(54) APPARATUS FOR AUTOMATICALLY RETURNING A LOCK TO A DESIRED ORIENTATION

(75) Inventors: Doug Trent, Roanoke, VA (US); Glenn Hartman, Salem, VA (US)

(73) Assignee: Medeco Security Locks, Inc., Salem, VA (US)

( * ) Notice: Subject to any disclaimer, the term of this patent is extended or adjusted under 35 U.S.C. 154(b) by 0 days.

(21) Appl. No.: 13/605,607

(22) Filed: Sep. 6, 2012

(65) Prior Publication Data

US 2013/0061644 A1 Mar. 14, 2013

Related U.S. Application Data

(60) Provisional application No. 61/532,175, filed on Sep. 8, 2011.

(51) Int. Cl.

*E05B 47/06* (2006.01)
*E05B 47/00* (2006.01)
*E05B 9/04* (2006.01)

(52) U.S. Cl.

CPC ..... *E05B 47/0012* (2013.01); *E05B 47/0615* (2013.01); *E05B 47/063* (2013.01); *E05B 2047/0058* (2013.01); *E05B 2009/047* (2013.01); *Y10S 70/33* (2013.01); *Y10S 70/36* (2013.01); *Y10S 292/61* (2013.01)

USPC ..... 70/277; 70/278.7; 70/279.1; 70/283; 70/366; 70/379 R; 70/495; 70/DIG. 33; 70/DIG. 36; 292/336.3; 292/336.5; 292/347; 292/DIG. 61

(58) Field of Classification Search

USPC ..... 70/495, 496, 379 R, 379 A, 380, 381, 70/278.1, 278.2, 278.3, 278.7, 279.1, 283, 70/283.1, 277, DIG. 32, DIG. 33, DIG. 36, 70/DIG. 52, DIG. 53, DIG. 54, DIG. 55, 70/218, 222, 223, 365, 366, 422; 292/336.5, 355, 359, DIG. 52, DIG. 61, 292/DIG. 72, 336.3, 347; 16/412, 414, 417, 16/441, 442, DIG. 30; 74/553, 25, 526, 74/527, 535–538, 554–556; 267/154, 155

See application file for complete search history.

(56) References Cited

U.S. PATENT DOCUMENTS

| | | | | |
|---|---|---|---|---|
| 1,256,663 | A * | 2/1918 | Cunningham | 70/218 |
| 1,565,754 | A * | 12/1925 | Orth | 464/39 |
| 1,675,465 | A * | 7/1928 | Roehrich | 70/255 |

(Continued)

FOREIGN PATENT DOCUMENTS

EP 1746229 A2 1/2007

*Primary Examiner* — Lloyd Gall

(74) *Attorney, Agent, or Firm* — Rothwell, Figg, Ernst & Manbeck PC

(57) ABSTRACT

An electromechanical lock includes a spring-biased cylinder plug return mechanism for automatically rotating the rotatable plug to a home position after the plug has been rotated from the home position and thereafter released. In one embodiment, the cylinder plug return mechanism comprises a torsional spring coupled to the plug, In a second embodiment, the cylinder plug return mechanism comprises a slider that is coupled to the plug so that rotation of the plug moves the slider, thereby increasing the potential energy in a return spring, and when the plug is released, the increase potential energy is released by moving the slider, and the coupling between the slider and the plug causes the plug to rotate back to a home position.

17 Claims, 8 Drawing Sheets

(56) References Cited

U.S. PATENT DOCUMENTS

| | | | | | |
|---|---|---|---|---|---|
| 1,910,125 | A | * | 5/1933 | Root | 74/556 |
| 1,917,778 | A | * | 7/1933 | Smith | 70/388 |
| 2,034,746 | A | * | 3/1936 | Ciak et al. | 292/347 |
| 3,625,032 | A | * | 12/1971 | Muhleck | 70/202 |
| 3,783,661 | A | * | 1/1974 | Greenwald | 70/419 |
| 4,138,869 | A | * | 2/1979 | Pelcin | 70/151 R |
| 4,324,308 | A | * | 4/1982 | Clendenen | 180/315 |
| 4,676,083 | A | * | 6/1987 | Sedley et al. | 70/276 |
| 4,689,977 | A | * | 9/1987 | Wolniak et al. | 70/379 R |
| 4,941,697 | A | * | 7/1990 | Fan | 292/336.3 |
| 5,010,750 | A | * | 4/1991 | Boser et al. | 70/276 |
| 5,235,832 | A | * | 8/1993 | Lux et al. | 70/368 |
| 5,542,274 | A | * | 8/1996 | Thordmark et al. | 70/495 |
| 5,623,844 | A | * | 4/1997 | Draeger | 70/408 |
| 5,630,331 | A | * | 5/1997 | Miyamoto | 70/379 R |
| 5,699,686 | A | * | 12/1997 | Neumayer et al. | 70/283 |
| 5,715,715 | A | * | 2/1998 | Nunez | 70/283 |
| 5,839,307 | A | * | 11/1998 | Field et al. | 70/283 |
| 5,882,053 | A | * | 3/1999 | Bekins et al. | 292/336.3 |
| 5,887,465 | A | * | 3/1999 | Shen | 70/224 |
| 6,059,326 | A | * | 5/2000 | Tramontina | 292/169 |
| 6,351,976 | B1 | * | 3/2002 | Chen | 70/224 |
| 6,374,653 | B1 | * | 4/2002 | Gokcebay et al. | 70/278.3 |
| 6,527,314 | B2 | * | 3/2003 | Brown | 292/336.3 |
| 6,604,394 | B2 | | 8/2003 | Davis | |
| 6,826,935 | B2 | * | 12/2004 | Gokcebay et al. | 70/278.3 |
| 6,837,083 | B2 | * | 1/2005 | Katagiri et al. | 70/379 R |
| 6,869,116 | B2 | * | 3/2005 | Dalsing | 292/358 |
| 6,895,792 | B2 | | 5/2005 | Davis | |
| 7,559,219 | B2 | * | 7/2009 | Chen | 70/224 |
| 7,845,202 | B2 | | 12/2010 | Padilla et al. | |
| 7,870,769 | B2 | * | 1/2011 | Andersson | 70/278.7 |
| 8,028,553 | B2 | * | 10/2011 | Lange | 70/277 |
| 8,419,081 | B2 | * | 4/2013 | Zhang | 292/92 |
| 2002/0180220 | A1 | * | 12/2002 | Bacon | 292/336.3 |
| 2006/0156771 | A1 | * | 7/2006 | Hauri | 70/278.7 |
| 2008/0072636 | A1 | * | 3/2008 | Padilla et al. | 70/278.7 |
| 2008/0111384 | A1 | * | 5/2008 | Ellis | 292/336.3 |
| 2008/0134736 | A1 | * | 6/2008 | Andersson | 70/279.1 |
| 2008/0141743 | A1 | * | 6/2008 | Andersson | 70/283 |
| 2010/0201137 | A1 | * | 8/2010 | Wartel | 292/336.3 |
| 2011/0074167 | A1 | * | 3/2011 | Taufman et al. | 292/83 |

* cited by examiner

APPARATUS FOR AUTOMATICALLY RETURNING A LOCK TO A DESIRED ORIENTATION

PRIORITY CLAIM

This application claims the benefit under 35 U.S.C. §119 (e) of U.S. Provisional Application No. 61/532,175, filed Sep. 8, 2011, the disclosure of which is hereby incorporated by reference in its entirety.

FIELD OF THE INVENTION

This invention is related to an apparatus that automatically returns a cylinder plug lock to a home rotational position after a rotational force that rotates the cylinder plug away from the home rotational position is removed.

BACKGROUND

In a typical pin tumbler lockset—also known as a cylinder lock—there is a cylinder plug mounted for rotation within a housing. When the cylinder plug is rotated, it actuates a lockset mechanism to pull in a latch or activate a deadbolt function to lock or unlock the door. The movement of the lockset mechanism is based on the rotation of a properly bitted key inserted into a keyway in the cylinder plug, and a cam or tailpiece is attached to the cylinder plug and is coupled to the lockset mechanism. Twisting the key rotates the plug, thereby turning the cam or tailpiece and actuating the locket mechanism.

Mechanically keyed cylinders require that the cylinder plug be returned to the home, or "locked," position in order to remove the key. This is due to the fact that the key is captured by the pin tumblers of the cylinder until the cylinder plug is rotated back to the home position and the pin tumblers can disengage the key, thereby permitting the key to be removed from the keyway. Thus, after opening the lock, the user must rotate the key back to the locked position before he can withdraw his key from the lock. This ensures that the cylinder plug, and any cam or tailpiece attached to the plug, is positioned back in the home or "locked" position as well. Typically, the cam or tailpiece is rotated away from the lockset mechanism and is in a position out of the way of any of the lockset drive mechanism when the cylinder plug is in the locked rotational position. For one-way doors, such as emergency exit doors that are locked from the outside but are unlocked from the inside in case emergency exit through the door is required, moving the cam or tailpiece away from the lockset mechanism ensures that the cam or tailpiece will not interfere with the lockset in any manner that may affect the ability to actuate the lockset and open the door from inside.

Certain electronic variations of the cylinder lock have a thumb turn or "knob" coupled to the lockset—e.g., via a "plug"—and do not include pin tumblers or do not employ a mechanical key to actuate the cylinder/lockset mechanism. An electronically-controlled (e.g., by an electric motor or solenoid) blocking element is configured to selectively block or permit rotation of the knob and the cylinder plug. In the locked condition, the blocking element is configured in a state that blocks rotation of the knob and the cylinder plug. When a valid credential, which may, for example, comprise an RFID tag, is presented by the user to a reader of the electronic lock, the state of the blocking element is electronically altered to an unlocked condition that permits rotation of the knob. With the blocking element in the unlocked condition, the user can rotate the knob which is coupled to the cam or tailpiece through the plug (as is in the mechanical cylinder lock) and operate the lockset mechanism. In this example, there is no key captured within the lock which requires that the user return the cylinder plug back to the home, or locked, position so that the key can be removed. Nevertheless, it is necessary for the user to manually return the knob attached to the cylinder plug back to the home position in order to relock the cylinder plug and move the cam back to the home position to disengage the lockset mechanism. If the knob is not returned to the locked position, for example, if the user simply forgets to return the knob to the locked position, the cylinder plug will remain in the unlocked condition, thereby cause a security lapse. In addition, the cam or tail piece will not be returned to a home position and may be left stranded in a position engaged with the lockset. This could interfere with operation of the lockset. For example, for doors that are locked on one side and opened on the opposite side, interference with the lock set could prevent opening of the door from the opened side.

Relying on the user to remember to manually return the cylinder plug to the locked, home position to ensure that the cylinder lock is relocked or to ensure that the cam attached to the plug is returned to the home position, is not ideal.

Thus, there is a need in cylinder locks that must be returned to the home, or locked, position to provide an automatic return feature that automatically returns the cylinder plug to the home position.

SUMMARY OF THE INVENTION

Aspects of the invention are embodied in a cylinder lock including a spring-biased cylinder plug return mechanism that automatically returns the cylinder plug to a home position when the plug is released by the user. In one embodiment, the plug is coupled to the knob by which a user rotates the plug from a locked position to an unlocked position, and the plug is released when the user releases the knob.

In a first embodiment of the invention, a torque spring is used. One end of the torque spring is attached to the shell that is fixed. The other end of the torque spring is attached to a rotating collar that is affixed to the plug and rotates in conjunction with the plug. The plug is rotatable within the shell. When the plug is rotated from an original, or home, or locked, rotational position, the collar also rotates, and the torque spring is loaded with rotational force-generating elastic potential energy. When the plug is released, the torque spring releases the stored energy and rotates the plug and collar back toward the original, or home, or locked, position at zero degrees. This design may include hard stops that limit the amount of rotation of the plug to less than 180 degrees to ensure that the torque spring returns the plug and collar in the opposite direction from which it was rotated.

In a second embodiment of the invention, a spring loaded slider interacts with a projection extending from a shaft of the knob that is rotatable with, or is an extension of, the plug, such as a drive pin attached to the shaft. The spring-biased cylinder plug return mechanism includes a slider having a cylindrical body that surrounds the shaft and an angled cam surface that engages the drive pin and a return spring. The slider and the shaft/plug are rotatable with respect to each other so that the shaft can rotate freely inside the slider. The slider is keyed to the shell or housing to prevent rotation of the slider with the plug. The slider is free to move forward and backward in an axial direction with respect to the plug.

The axial position of the slider is biased outwardly, away from the housing, by the return spring, and the slider axial travel is limited by the drive pin on the shaft. As the knob and shaft are rotated (thereby rotating the plug), the angled cam surface of the slider stays in constant contact with the drive pin due to the outward spring force on the slider by the return spring. The cam surface is preferably a flat surface oriented at an acute angle (e.g., 45 degrees) with respect to the longitudinal axis of the shaft (and cylinder plug). The angled cam surface of the slider engages the drive pin when the shaft is rotated, and, in cooperation with the return spring, causes the slider to move axially forwards (toward the knob and away from the housing) or backwards (away from the knob and towards the housing) depending on the position of the drive pin in the rotation of the knob shaft. When the slider is moved backwards toward the shell the return spring is compressed. When the knob is released, the spring will cause the slider to move toward the knob, the drive pin, which is attached to the shaft, will be moved along the cam surface to its home position, and the knob will be correspondingly rotated to the home position.

DETAILED DESCRIPTION

Figure 1:
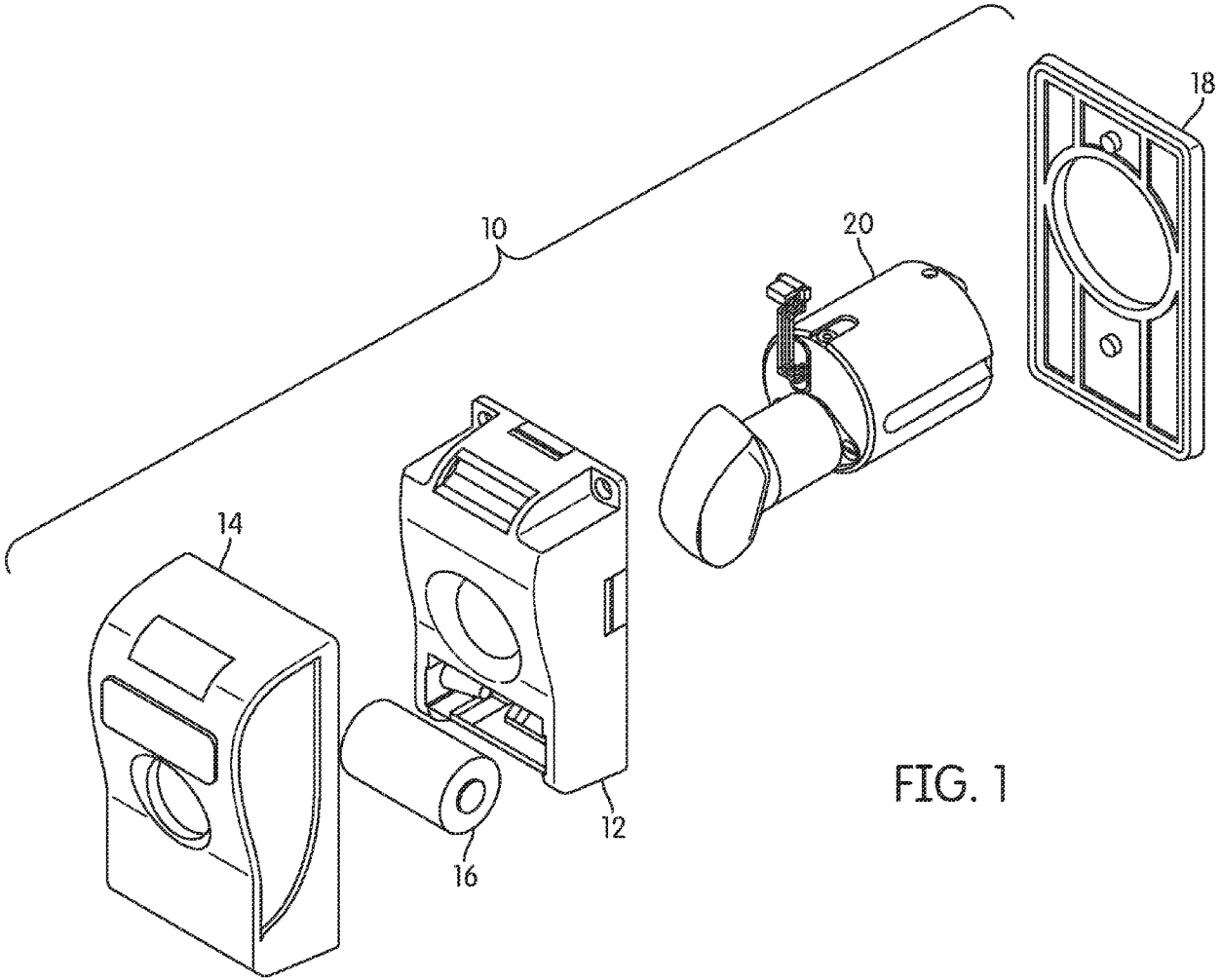
FIG. 1 is an exploded perspective view of an electronic, thumb-turn cylinder lock assembly embodying aspects of the present invention.

An electronic, thumb-turn cylinder lock assembly including an electronic, thumb-turn cylinder lock embodying aspects of the present invention is indicated by reference number 10 in FIG. 1. The assembly 10 includes the thumb-turn cylinder lock 20 embodying aspects of the present invention, a reader box 12 with a battery 16 and a box cover 14 mounted on a mounting plate 18. The reader box 12 includes electronic components for controlling functions of the lock 20, including a micro-controller. The micro-controller of the reader box 12 may comprise a microprocessor in communication with memory, such as, electronically erasable programmable read-only memory (EEPROM), and is associated with functions related to the operation of the lock 20, such as comparing information, executing algorithms to effect operation of the lock, and storing information relating to authorization codes (e.g., access credentials), passwords, lock activation events (e.g., audit events, such as, entry), and other data. The reader box 12 further includes an access control reader that receives access signals from, e.g., a access card, fob, or other device. The signals may comprise authentication codes (e.g. access credentials). The electronics of the reader box 12 are powered by the battery 16. In an alternative embodiment, the reader box 12 may be connected to AC power as an alternative to, or in addition to, the battery 16.

Figure 2:
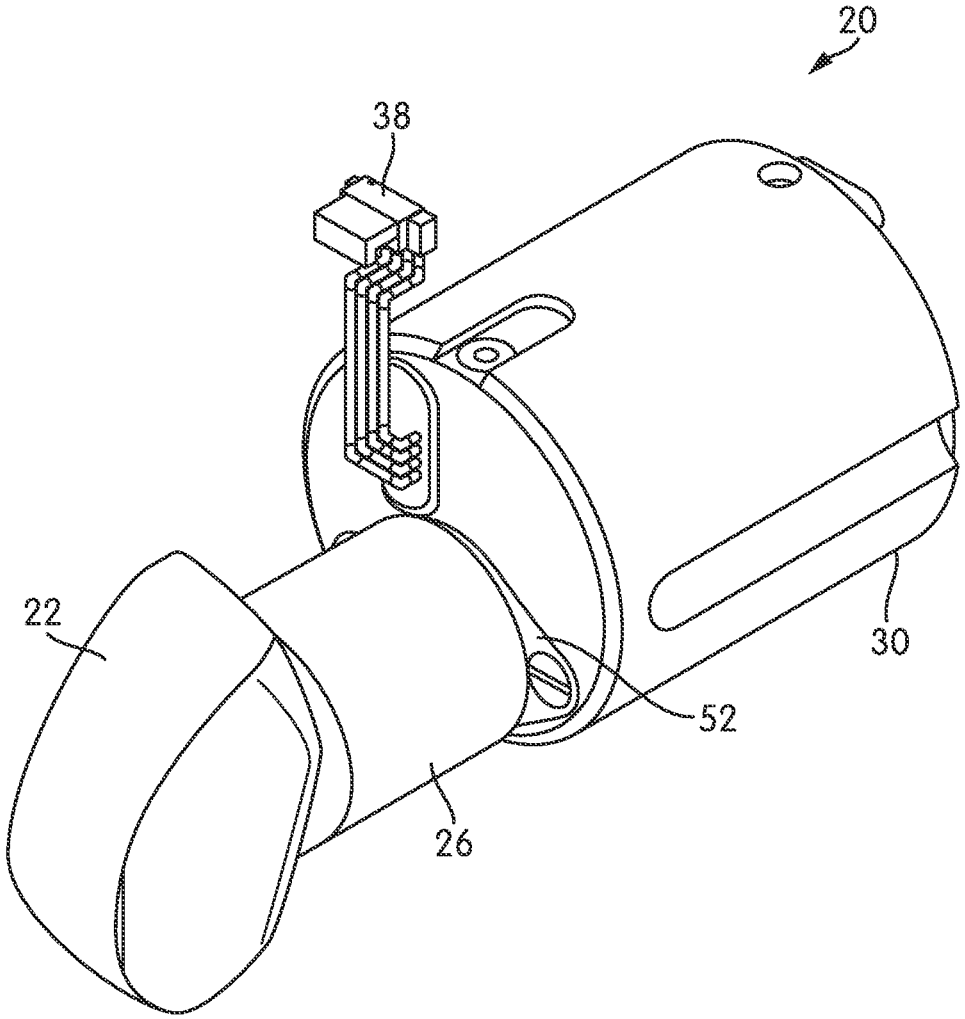
FIG. 2 is a perspective view of a first embodiment of a thumb-turn cylinder lock embodying aspects of the present invention.
Figure 3:
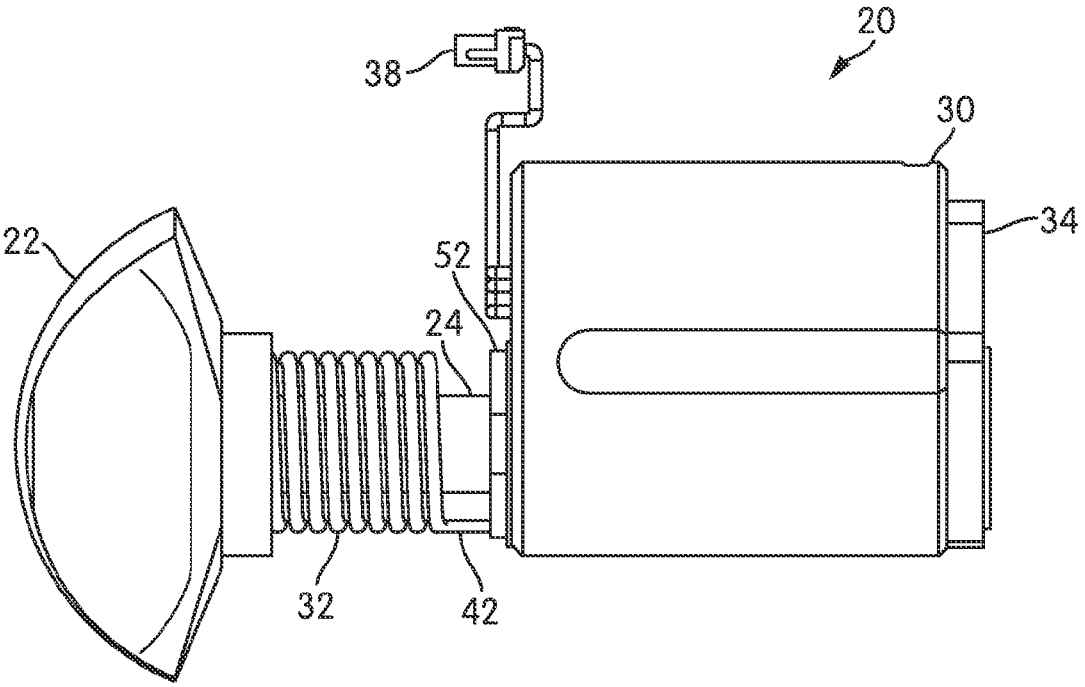
FIG. 3 is a side view of the electronic, thumb-turn cylinder lock of FIG. 2 with a spring collar omitted.
Figure 4:
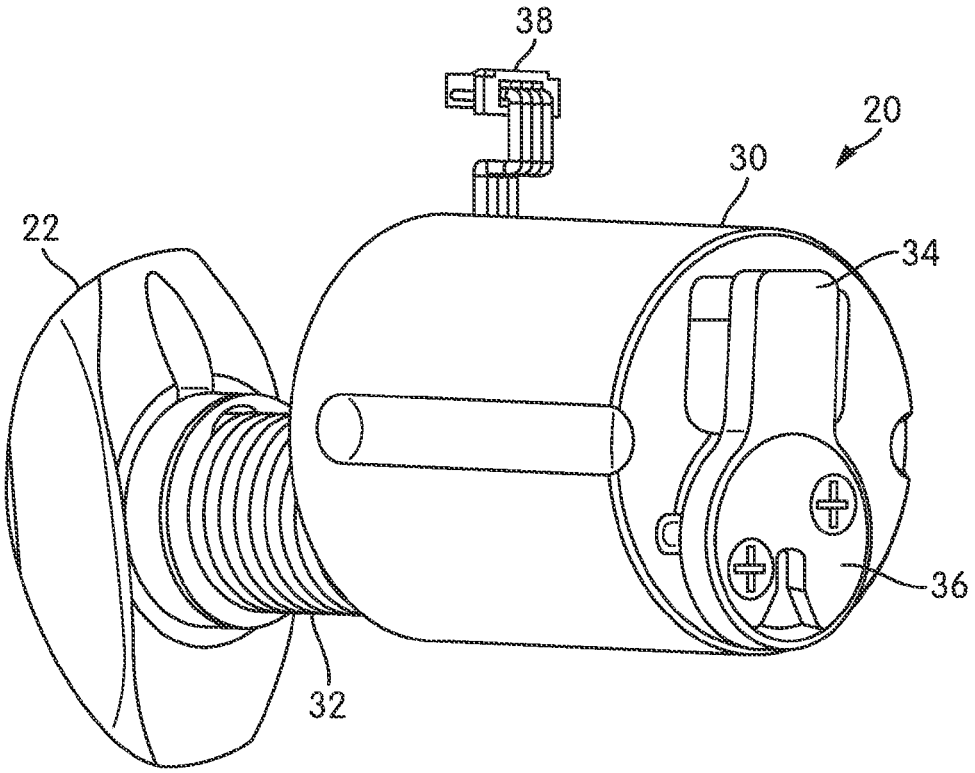
FIG. 4 is a rear-end perspective view of the thumb-turn cylinder lock of FIG. 2 with the spring collar omitted.
Figure 5:
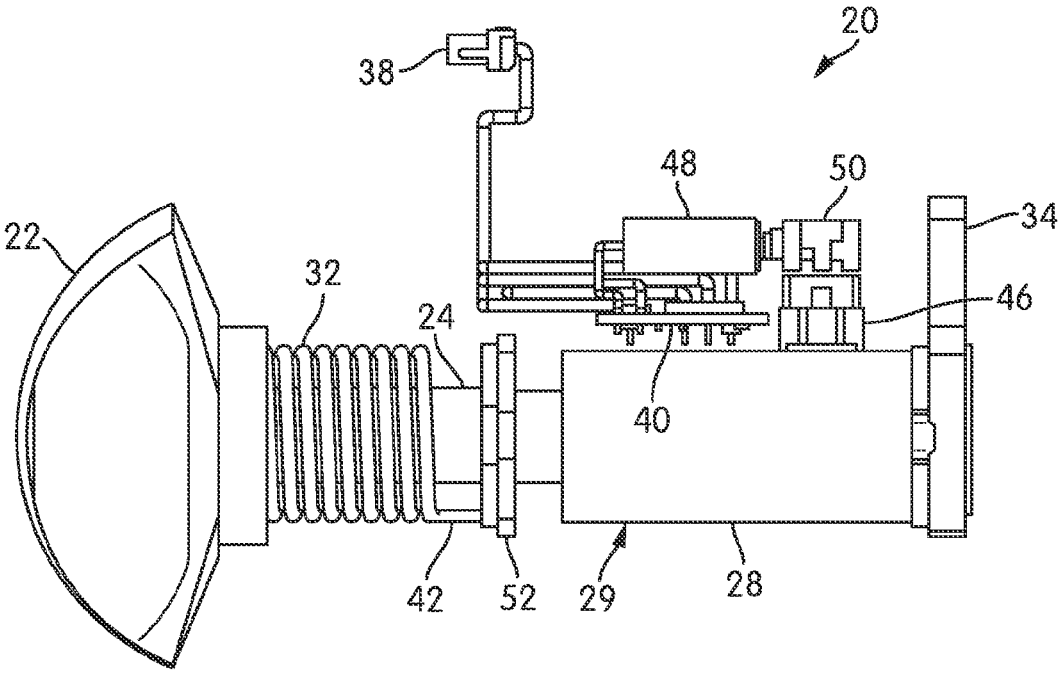
FIG. 5 is a side view of the thumb-turn cylinder lock of FIG. 2 with the spring collar and the cylinder housing omitted.
Figure 6:
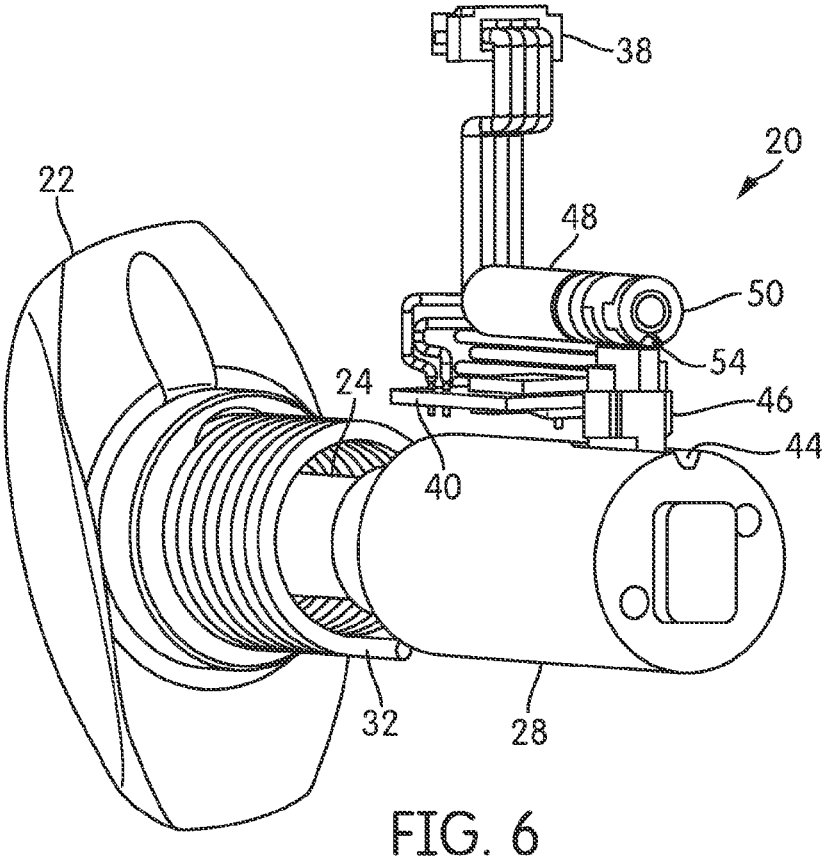
FIG. 6 is a rear-end perspective view of the thumb-turn cylinder lock of FIG. 2 with the spring collar, housing, retainer plate, cam, and cam retainer plate omitted.

Details of the cylinder lock 20 are shown in FIGS. 2-6. As shown in FIGS. 2 and 3, the lock 20 includes a cylinder housing, or shell, 30, a thumb-turn knob 22, and a wire-connector 38 for connecting the lock 20 to the reader box 12. As shown in FIGS. 5 and 6, the lock 20 includes a cylinder 29 which comprises a cylinder plug 28 (or plug), rotatably disposed within the housing 30, and a shaft 24 extending from the plug 28. As shown in FIG. 3, the thumb-turn knob 22 is attached to the shaft 24. The cylinder lock 20 is coupled to a door lock assembly by a cam 34. As shown in FIG. 4, the cam 34 is attached to and rotatable with the plug 28 by means of a cam retainer 36 that is secured to the cylinder by screws or other mechanical fasteners. In an alternate embodiment, not shown, a tail piece may extend from the plug 28 and be coupled to a door latch or deadbolt assembly.

Rotation of the plug 28 within the housing 30 is controlled by a sidebar 46 that is engageable with a longitudinal slot 44 formed in the plug 28 (see FIGS. 5 and 6). The sidebar 46 is biased radially inwardly relative to the axis of rotation of the plug 28.

The electronic lock assembly comprises a motor 48 with rotating tumblers 50 disposed on a shaft of the motor 48 and a printed circuit board (PCB) 40 that is in communication with the motor 48 and the reader box 12 via the wire connector 38. The PCB 40 includes a microcontroller, which may comprise a microprocessor in communication with memory, such as EEPROM, and is associated with functions related to the operation of the lock 20, such as comparing information, executing algorithms to effect operation of the lock, and storing information relating to authorization codes (e.g., access credentials), passwords, lock activation events (e.g. audit events, such as, entry), and other data. The microcontroller of the PCB 40 receives signals from the reader box 12 via the wire connector 38.

Release of the sidebar 46 is controlled by the tumblers 50 attached to a shaft of the motor 48. Each of the tumblers 50 includes a tumbler slot 54. When the lock 20 is in a locked condition, the tumbler slots 54 of the tumblers 50 are not aligned with each other, and preferably none of the slots 54 is aligned with the top portion of the sidebar 46. Accordingly, the sidebar 46 is prevented from disengaging from the longitudinal slot 44 by the tumblers 50, and rotation of the plug 28 is prevented. When a valid credential is presented to the reader box 12, the access credential codes are compared and confirmed within the reader box 12 and/or the PCB 40, and the PCB 40 transmits an unlocked signal to the motor 48 which rotates the tumblers 50 in a first direction that will cause the tumbler slots 54 to align with each other and with the top of the sidebar 46. Accordingly, when torque is applied to the plug 28 via the thumb-turn knob 22 and shaft 24, the end of the sidebar 46 is forced out of the longitudinal slot 44, and the plug 28 is able to rotate. When the plug 28 is returned to the home, or locked, position so that the longitudinal slot 44 is aligned with the sidebar 46, a biasing element, such as a spring (not shown) urges the sidebar 46 back into the longitudinal slot 44.

In one embodiment, a sensor element in the PCB 40 detects a magnet disposed within the cylinder 29, such as in the plug 28, to indicate that the plug 28 has been returned to the home position. Upon detecting that the plug 28 has been returned to the home position, the PCB 40 sends a lock signal to the motor 48, which rotates the tumblers 50 in an opposite direction to scramble the tumblers 50 so that the tumbler slots 54 are no longer aligned with each other.

A torsional spring 32 is arranged coaxially over the shaft 24. One end of the spring 32 is attached to a collar 26 that covers the spring 32 and is rotatable with the cylinder 29, and another portion 42 of the spring 32 is anchored in a retainer plate 52 that is attached to the housing 30 by mechanical fasteners, such as screws. In another embodiment, one end of the spring 32 is attached to the knob 22, and the other end is attached to the housing 30. When the thumb-turn knob 22 and shaft 24 are rotated when the lock 20 is unlocked, the torsional spring 32 is loaded to increase the potential energy stored in the spring 32. Thus, when the thumb-turn knob 22 is released, the thumb-turn knob 22, shaft 24, and plug 28 are returned to the home, or locked, position by the torsional return force stored in the spring 32. Thus, the spring 32 comprises a spring-biased cylinder return mechanism.

Preferably, the lock 20 includes hard stop elements (not shown) that prevent the thumb-turn knob 22 and shaft 24 from being rotated more than 180 degrees, which can cause the spring 32 to bind.

Figure 7:
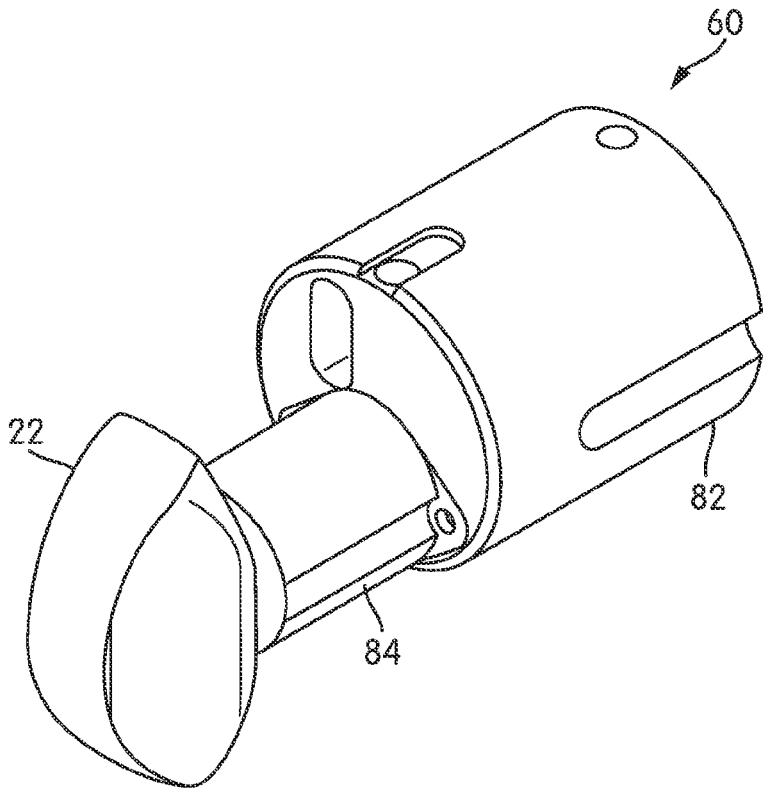
FIG. 7 is a perspective view of a second embodiment of a thumb-turn cylinder lock embodying aspects of the present invention.

FIG. 7 is a front perspective view of an alternate embodiment of a thumb-turn cylinder lock 60 embodying aspects of the present invention. The cylinder lock 60 includes a cylinder housing 82 that contains a rotatably mounted cylinder (not shown in FIG. 7) and a thumb-turn knob 22 attached to a shaft that comprises an extension from the cylinder or an extended portion of the cylinder projecting from the cylinder housing 82. The lock 60 further includes a collar 84 that houses a thumb-turn return mechanism, as will be described in more detail below. Cylinder lock 60 may further include an electronic locking mechanism comprising a motor, tumblers, sidebar, printed circuit board (including a micro-controller, and a wire connector for connecting the motor and PCB) to a reader box, as with the embodiment of the cylinder lock 20 shown in FIG. 2 and described above. For simplifying the figures, however, the components for the electronic locking mechanism are omitted from the description of the second embodiment shown in FIGS. 7-11.

Figure 8:
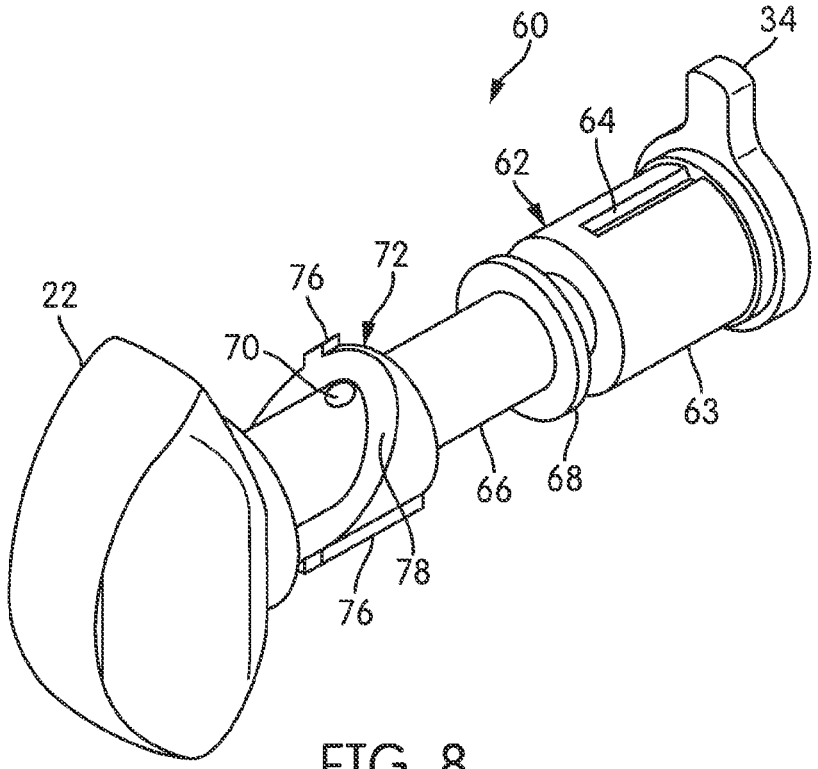
FIG. 8 is a perspective view of the thumb-turn cylinder lock of FIG. 7 with the cylinder housing, return spring, and collar omitted.

FIG. 8 shows a perspective view of the cylinder lock 60 with the cylinder housing 82, collar 84, and a return spring (described below) omitted from the figure. Cylinder lock 60 includes a cylinder 62 that is rotatable with respect to the housing 82 and comprises a cylinder plug (or plug) 63 rotationally disposed within the housing 82 with a longitudinal slot 64 (as described in the embodiment shown above), a shaft extension 66 that extends out of the housing 82 and to which the thumb-turn knob 22 is attached, a spring collar 68, and a drive pin 70 attached to the shaft extension 66. As with the embodiment described above, the lock 60 includes a cam 34.

Figure 9:
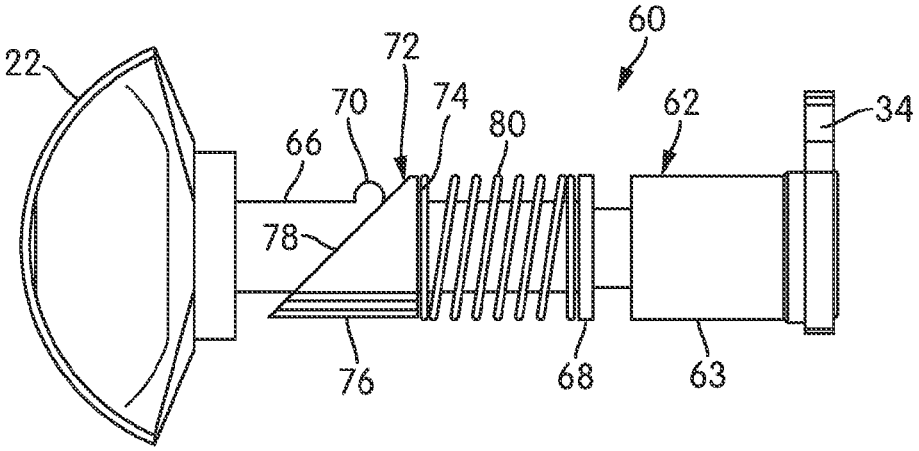
FIG. 9 is a side view of the thumb-turn cylinder lock of FIG. 7 with the cylinder housing and the collar omitted, and with the thumb-turn knob in a home position.

The shaft extension 66 extends through a slider 72 that comprises a cylinder structure having a back end 74 that is generally perpendicular to the longitudinal axis of the shaft extension 66 and a cam surface 78 that is formed at an acute angle relative to the longitudinal axis of the shaft extension 66. In one embodiment, as shown in FIG. 9, the cam surface 78 lies within a single plane oriented at an angle of approximately 45 degrees to a longitudinal axis of the shaft extension 66. A return spring 80 is disposed between the back end 74 of the slider 72 and the spring collar 68 extending radially from the shaft extension 66.

Figure 12A:
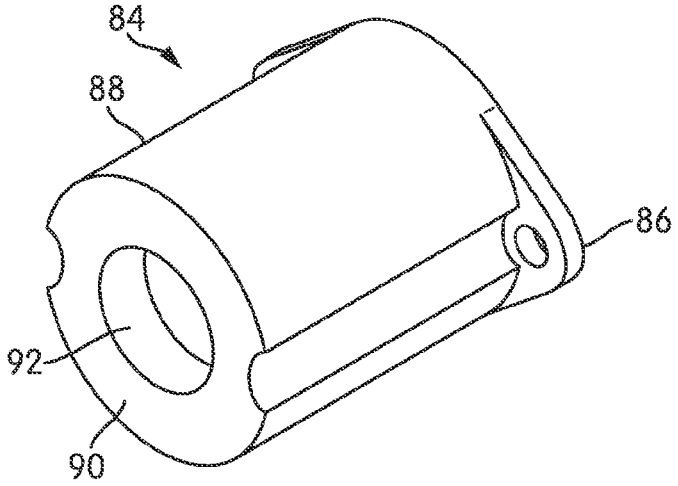
FIG. 12A is a front perspective view of the collar.
Figure 12B:
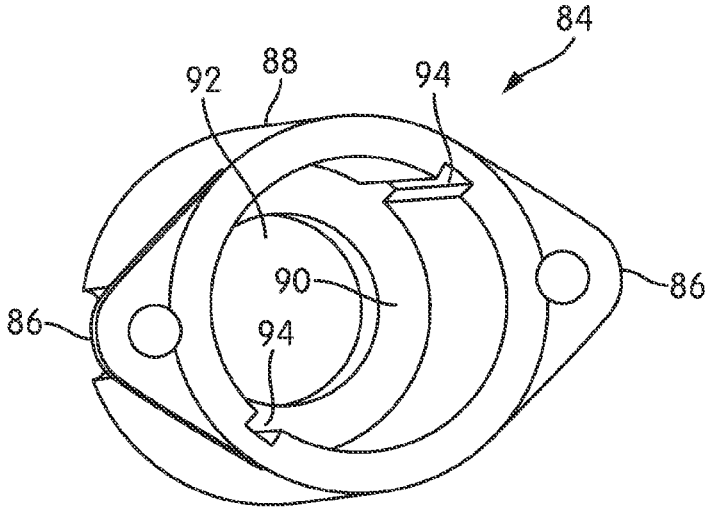
FIG. 12B is a rear perspective view of the collar.
Figure 12C:
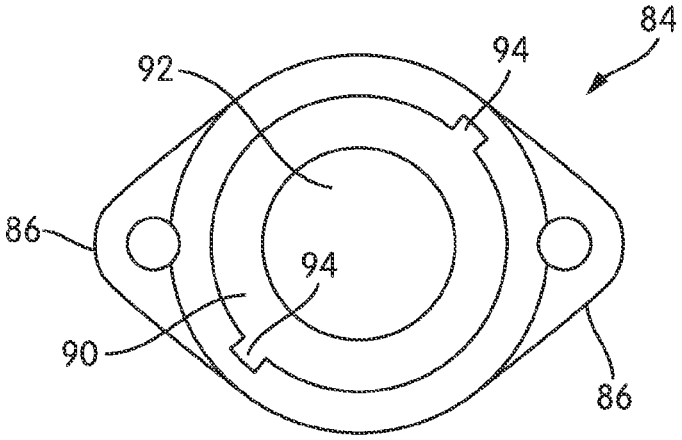
FIG. 12C is a rear end view of the collar.

The slider 76 is housed within the collar 84. As shown in FIGS. 12A-12C, the collar 84 has a cylindrical body 88 and attaching flanges 86 extending from the body 88 and with which the collar is secured to the cylinder housing 82 by means of mechanical fasteners, such as screws. The cylindrical body 88 defines a cylindrical interior portion, and the collar 84 has a partially closed front end 90 with a circular shaft opening 92 formed centrally therein. The shaft extension 66 extends through the opening 92. The slider 72 includes anti-rotation ridges 76 (see, e.g., FIG. 8) preferably formed on diametrically-opposed sides of the slider 72. The anti-rotation ridges 76 engage anti-rotation grooves 94 formed on the interior of the cylindrical body 88 of the collar 84. Accordingly, the slider 72 is able to move in an axial direction relative to its cylindrical axis and the longitudinal axis of the shaft extension 66, but is restricted from rotation about the longitudinal axis of the shaft extension 66. The shaft extension 66, on the other hand, is able to rotate about its longitudinal axis relative to the slider 72.

The cylinder lock 60 includes a spring-biased cylinder return mechanism comprising the slider 72 interacting with a projection extending from a shaft extension 66 that is rotatable with the plug 63 such as a drive pin 70 attached to the shaft 66. The knob 22 is attached to the shaft 66, which may extend from the plug 63 or which may be an extension of the plug 63.

The axial position of the slider 72 is biased outwardly, away from the housing 82, by the return spring 80. As the knob 22 and shaft 66 are rotated (thereby rotating the plug 63), the angled cam surface 78 of the slider 72 stays in constant contact with the drive pin 70 due to the outward spring force on the slider 72 by the return spring 80. As noted, the cam surface 78 is preferably a flat surface oriented at an acute angle (e.g., 45 degrees) with respect to the longitudinal axis of the shaft 66. Engagement of the drive pin 70 with the cam surface 78 translates rotational motion of the shaft 66 and cylinder plug 63 into axial translation of the slider 72, or the engagement translates axial translation of the slider into rotational motion of the shaft 66 and cylinder plug 63. The angled cam surface 78 of the slider 72 engages the drive pin 70 when the shaft 66 is rotated, and, in cooperation with the return spring 80, causes the slider 72 to move axially forwards (towards the knob 22) or backwards (away from the knob 22) depending on the position of the drive pin 70 in the rotation of the shaft 66. When the slider 72 is moved backwards away from the knob 22 the return spring 80 is compressed.

Figure 10:
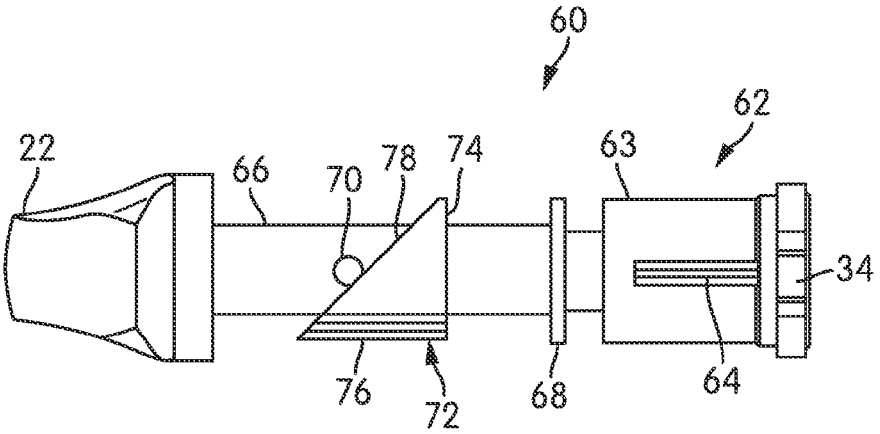
FIG. 10 is a side view of the thumb-turn cylinder lock of FIG. 7 with the cylinder housing, return spring, and collar omitted, and with the thumb-turn knob turned approximately 90 degrees from the home position.
Figure 11:
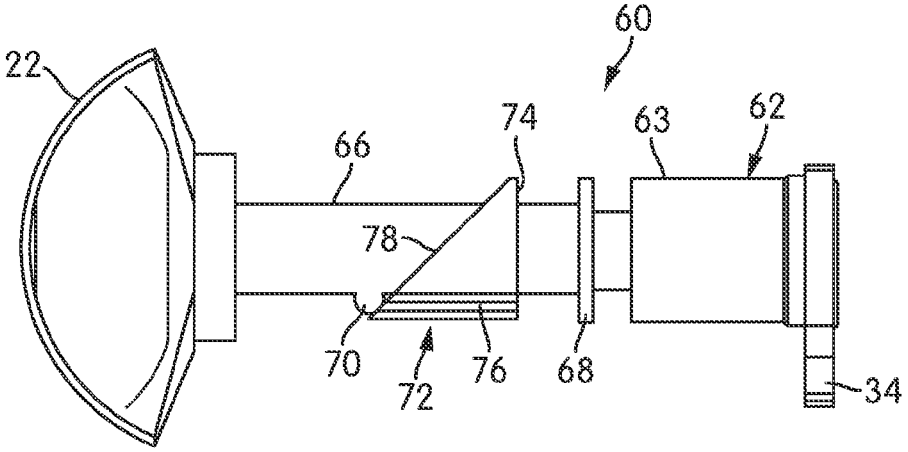
FIG. 11 is a side view of the thumb-turn cylinder lock of FIG. 7 with the cylinder housing, return spring, and collar omitted, and with the thumb-turn knob turned 180 degrees from the home position.

The spring 80 of the slider mechanism is in a relatively relaxed position when the drive pin 70 on the shaft 66 is at zero degrees rotation, as shown in FIG. 9. In the illustrated embodiment, zero degrees rotation corresponds to a top dead center position for the drive pin 70. This also corresponds to the home, or locked, position of the plug 63. When rotation of the shaft 66 begins in either direction (clockwise or counter clockwise), the drive pin 70 engaging the angled cam surface 78 of the slider 72 urges the slider 72 axially away from the knob 22, and the return spring 80 is compressed, which results in increased elastic potential energy being stored in the return spring 80. There is sufficient compressive force energy loaded onto the return spring 80 at any point beyond zero degrees of the shaft 66 for the angled cam surface 78 of the slider 72 to interact with the drive pin 70 on the shaft 66 and force rotation of the shaft 66 and plug 63 back to the zero degrees position when the user releases the thumb turn knob 22. More specifically, with the drive pin 70 engaged with the top of the angled cam surface 78 of the slider 72, at the zero degree rotation position as shown in FIG. 9, the slider 72 is at its closest axial position to the knob 22, and the return spring 80 is at its least compressed position. On the other hand, as the shaft 66 rotates, the drive pin 70, which has a fixed axial position on the shaft 66, moves along the angled cam surface 78 and forces the slider 72 radially away from the knob 22, thereby increasing the compression of the return spring 80. At 90 degrees rotation of the knob 22 and shaft 66, the drive pin 70 is at an intermediate position on the angled cam surface 78, as shown in FIG. 10. When the drive pin 70 reaches the bottom of the angled cam surface 78 of the slider 72, at the 180 degree rotation position, the slider 72 is at its furthest axial position relative to the knob 22, and the return spring 80 is at its most compressed position (i.e., the position with the most potential energy), as shown in FIG. 11. When the knob 22 is released from any rotational position other than zero degrees, the return spring 80 will seek its position of least compression as potential energy is released by the return spring 80, thereby forcing the slider 72 axially towards the knob 22. As the slider 72 moves axially towards the knob 22, the drive pin 70 will slide along the angled cam surface 78 toward the top end of the cam surface 78, thereby rotating the shaft 66, until the return spring 80 reaches its least compressed position.

Note that terms such as "top" or "bottom" in reference to the angled cam surface 78 of the slider 72 are non-limiting terms of convenience for describing the embodiment shown in the drawings. Persons of ordinary skill in the art will recognize that the slider 72 could be reoriented so that the "zero degree rotation position" corresponds to the bottom position of the angled cam surface 78 and the "180 degree rotation position" corresponds to the top of the angled cam surface 78.

When the plug 63 is rotated back to the home position, the plug 63 is allowed to relock, and the cam 34 is returned to a position out of the way of the lockset mechanism.

Figure 13:
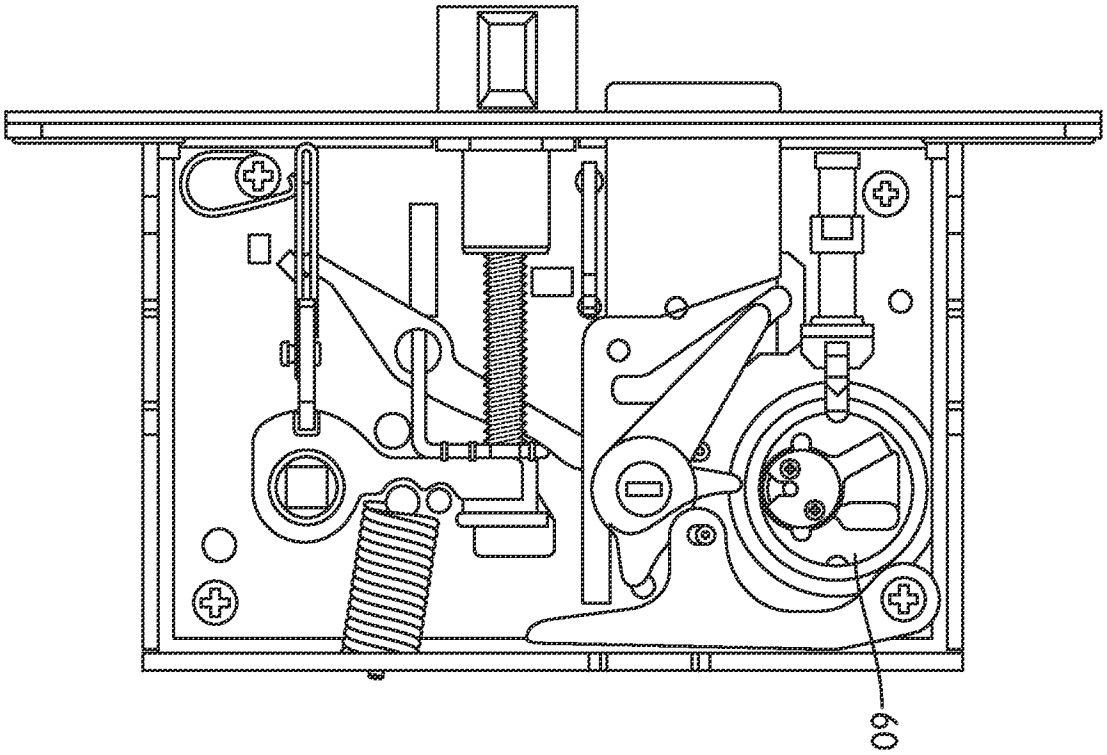
FIG. 13 is a side view of a typical mortise lock assembly with a cylinder lock embodying aspects of the present invention incorporated therein.

The inventors have further noted that when the shaft and associated drive pin is rotated to a position exactly 180 degrees from the home position (i.e., to a "peak" of the angled cam surface), the pin is at a location of equilibrium such that there is an equalizing effect on the slider mechanism that may prevent the slider mechanism from rotating the shaft either clockwise or counter clockwise back to the home position. There is typically some spring force that can be relied upon that is provided from the lock mechanism to help overcome this condition. Such spring force can come from a spring latch lock set, such as shown in FIG. 13.

Two types of lockset in which cylinders according to the present invention may be incorporated include a "spring latch" lockset and a "dead latch" or dead bolt lockset.

In the spring latch lockset, the cylinder is merely required to momentarily pull in the latch to open the door. The locking mechanism has a spring loaded latch bolt with which the spring is compressed as the latch bolt is moved towards the unlocked position. Once the cam or tailpiece releases the spring latch bolt, it will attempt to "spring" back out into the locked position. This additional spring force inside the lockset will provide the cylinder with some assistance in returning to the home position until lockset disengages with the cam of the cylinder. In the spring latch application, a cylinder with 180 degree rotation limitation, such as the cylinder 20 shown in FIGS. 2-6, works fine. The cylinder return spring 32 can be installed such that it can work in either clockwise or counter clockwise directions up to the 180 degrees position. This is required because some doors are right handed and some doors are left handed relative to the hinges and lockset.

In a "dead latch" or dead bolt lockset, a cylinder that is limited to 180 degree rotation will not work. To operate the deadbolt function, the cam or tailpiece must be rotated up to, and beyond, 360 degrees to move the bolt from the locked to unlocked positions and vice versa. For this application the cylinder 60 shown in FIGS. 7-12 is more suitable.

The cylinder lock 60 of FIGS. 7-12 has other advantages. The cylinder lock 60 is configured to allow the cylinder plug 63 to be returned to the locked position from any rotational position relative to the locked position. In one embodiment, the cylinder lock 60 is also configured such that engagement of the drive pin 70 with the cam surface 78 causes the cylinder plug 63 to rotate either clockwise or counter clockwise toward the locked position on a path of least resistance to return the cylinder plug 63 to the locked position. In addition, the spring-biased cylinder plug return mechanism of the cylinder lock 60 is configured so that the cylinder plug 63 can be rotated from the locked position beyond 360 degrees in either direction necessary to drive a lock mechanism and the cylinder plug 63 will still return to the locked position when the knob 22 is released by the user.

While the present invention has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the inventions requires features or combinations of features other than those expressly recited in the claims. Accordingly, the present invention is deemed to include all modifications and variations encompassed within the spirit and scope of the following appended claims.

The invention claimed is:

1. A cylinder lock comprising:

a housing;

a cylinder plug rotatably mounted within the housing, and configured such that the cylinder lock is unlocked by rotation of said cylinder plug from a home rotational position; and a spring-biased cylinder plug return mechanism, operatively coupled to said cylinder plug and configured to exert a rotating force to said cylinder plug that will cause said cylinder plug to rotate toward the home rotational position, wherein said spring-biased cylinder plug return mechanism is configured so that the cylinder plug can be rotated from the home rotational position beyond 360 degrees in either direction and will return to the home rotational position from any rotational position when the cylinder plug is released by the user.

2. The cylinder lock of claim 1, wherein said spring-biased cylinder plug return mechanism comprises:

a slider movable with respect to said cylinder plug;

a return spring coupled to said slider; and a coupling between said slider and said cylinder plug, wherein, as the cylinder plug is rotated from the home rotational position, said coupling is constructed and arranged to move said slider in a first direction to deflect said return spring to increase potential energy stored in said return spring, and when said cylinder plug is released, the potential energy in said return spring is released to move the slider in a second direction opposite to the first direction and said coupling is constructed and arranged to exert the rotating force to cause said cylinder plug to rotate toward the home rotational position.

3. The cylinder lock of claim 2, wherein said coupling between said slider and said cylinder plug comprises:

a cam surface on said slider; and a projection extending from said cylinder plug and rotatable therewith, said projection being engaged with said cam surface of said slider, wherein, as the cylinder plug is rotated from the home rotational position, engagement of the projection with the cam surface moves the slider in the first direction and deflects said return spring to increase potential energy stored in said return spring, and when said cylinder plug is released, the potential energy in said return spring is released to move the slider in the second direction opposite to the first direction and the engagement of said projection with said cam surface exerts the rotating force to cause said cylinder plug to rotate toward the home rotational position.

4. The cylinder lock of claim 2, wherein said slider comprises a body of revolution having a central opening through which a portion of said plug extends, wherein said plug is rotatable with respect to said slider about a longitudinal axis of said plug, and said slider is configured to be movable in an axial direction with respect to said plug.

5. The cylinder lock of claim 4, further comprising a collar disposed over said slider and attached to said housing, said collar including anti-rotation elements, wherein said slider includes anti-rotation elements configured to engage the anti-rotation elements of said collar to prevent rotation of said slider when said plug rotates with respect to said slider.

6. The cylinder lock of claim 3, wherein engagement of said projection with said cam surface causes said cylinder plug to rotate either clockwise or counter clockwise toward the home rotational position on a path of least resistance to return the cylinder plug to the home rotational position.

7. The cylinder lock of claim 1, further comprising:

a sidebar configured to engage a slot formed in said plug to prevent rotation of said plug;

rotational tumblers each having a slot formed therein, whereby when said tumblers are oriented such that the respective slots thereof are aligned, said sidebar is able to move into the aligned slots of the rotational tumblers and disengage the slot formed in said plug to thereby permit said plug to be rotated; and a motor configured to rotate said rotational tumblers.

8. The cylinder lock of claim 7, further comprising a microprocessor configured to control said motor to rotate said rotational tumblers into a first orientation in which the respective slots thereof are not aligned or a second orientation in which the respective slots thereof are aligned.

9. The cylinder lock of claim 8, further comprising a signal reader in communication with said microprocessor, wherein said microprocessor is configured to interpret a signal transmitted to said reader and if the signal presents a proper credential, to cause the motor to rotate the rotational tumblers from the first orientation to the second orientation.

10. The cylinder lock of claim 1, further comprising a thumb knob attached to said plug.

11. A cylinder lock comprising:

a housing;

a cylinder plug rotatably mounted within the housing, and configured such that the cylinder lock is unlocked by rotation of said cylinder plug from a home rotational position; and a spring-biased cylinder plug return mechanism, operatively coupled to said cylinder plug and configured to exert a rotating force to said cylinder plug that will cause said cylinder plug to rotate toward the home rotational position, said spring-biased cylinder plug return mechanism comprising:

a slider movable with respect to said cylinder plug;

a return spring coupled to said slider; and a coupling between said slider and said cylinder plug, wherein, as the cylinder plug is rotated from the home rotational position, said coupling is constructed and arranged to move said slider in a first direction to deflect said return spring to increase potential energy stored in said return spring, and when said cylinder plug is released, the potential energy in said return spring is released to move the slider in a second direction opposite to the first direction and said coupling is constructed and arranged to exert the rotating force to cause said cylinder plug to rotate toward the home rotational position.

12. The cylinder lock of claim 11, wherein said coupling between said slider and said cylinder plug comprises:

a cam surface on said slider; and a projection extending from said cylinder plug and rotatable therewith, said projection being engaged with said cam surface of said slider, wherein, as the cylinder plug is rotated from the home rotational position, engagement of the projection with the cam surface moves the slider in the first direction and deflects said return spring to increase potential energy stored in said return spring, and when said cylinder plug is released, the potential energy in said return spring is released to move the slider in the second direction opposite to the first direction and the engagement of said projection with said cam surface exerts the rotating force to cause said cylinder plug to rotate toward the home rotational position.

13. The cylinder lock of claim 11, wherein said slider comprises a body of revolution having a central opening through which a portion of said plug extends, wherein said plug is rotatable with respect to said slider about a longitudinal axis of said plug, and said slider is configured to be movable in an axial direction with respect to said plug.

14. The cylinder lock of claim 11, wherein said spring-biased cylinder plug return mechanism is configured to allow said cylinder plug to be returned to the home rotational position from any rotational position relative to the home rotational position.

15. The cylinder lock of claim 11, wherein said spring-biased cylinder plug return mechanism is configured so that the cylinder plug can be rotated from the home rotational position beyond 360 degrees in either direction and the cylinder plug will return to the home rotational position when the cylinder plug is released by the user.

16. The cylinder lock of claim 11, further comprising:

a sidebar configured to engage a slot formed in said plug to prevent rotation of said plug;

rotational tumblers each having a slot formed therein, whereby when said tumblers are oriented such that the respective slots thereof are aligned, said sidebar is able to move into the aligned slots of the rotational tumblers and disengage the slot formed in said plug to thereby permit said plug to be rotated;

a motor configured to rotate said rotational tumblers; and a microprocessor configured to control said motor to rotate said rotational tumblers into a first orientation in which the respective slots thereof are not aligned or a second orientation in which the respective slots thereof are aligned.

17. The cylinder lock of claim 11, further comprising a thumb knob attached to said plug.

* * * * *